United States Patent [19]

Westerlund

[11] Patent Number: 4,502,570

[45] Date of Patent: Mar. 5, 1985

[54] DRIVE SYSTEM FOR WIRE ROPE HOISTS

[75] Inventor: Tage S. Westerlund, Skelleleå, Sweden

[73] Assignee: Linden-Alimak AB, Skelleftea, Sweden

[21] Appl. No.: 431,295

[22] Filed: Sep. 30, 1982

[51] Int. Cl.[3] ..... B66B 7/10

[52] U.S. Cl. ..... 187/22; 187/27; 74/501.5 R; 254/328; 254/393

[58] Field of Search ..... 74/501.5 R; 187/20, 187/22, 23, 26, 27, 1 A; 254/328, 393; 182/141, 142

[56] References Cited

U.S. PATENT DOCUMENTS

| | | | |
|---|---|---|---|
| 796720 | 8/1905 | Hanscom | 74/501.5 R X |
| 907,994 | 12/1908 | Haddow | 187/23 X |
| 964,842 | 7/1910 | Boening | 187/23 X |
| 1,507,712 | 9/1924 | Proudfoot | 254/393 X |
| 3,565,217 | 10/1968 | St. Louis | 187/27 |
| 3,641,835 | 2/1972 | Tornheim | 74/501.5 |

FOREIGN PATENT DOCUMENTS

| | | |
|---|---|---|
| 478679 | 11/1976 | Australia . |
| 9019 | of 1911 | United Kingdom . |

*Primary Examiner*—Joseph J. Rolla
*Assistant Examiner*—Lawrence J. Miller
*Attorney, Agent, or Firm*—Curtis Ailes

[57] ABSTRACT

A hoist cage is supported by a loop of rope extending around a drive sheave and an idler sheave respectively positioned at the ends of the hoist cage path and attached to the hoist cage by attachment of separate ends of the loop to separate drums rotatably attached to the hoist cage. The drums are coupled to rotate together to take up and pay out rope at different rates and in opposite senses with the rate being higher for the drum from which the rope extends downwardly.

6 Claims, 2 Drawing Figures

DRIVE SYSTEM FOR WIRE ROPE HOISTS

BACKGROUND OF THE INVENTION

The present invention relates to a drive system for wire rope hoists.

In a conventional traction drive arrangement for wire rope hoists the rope tension over the drive sheave is obtained due to the fact that the ropes at one end carry the weight of the hoist cage plus load and at the other end carry a counterweight.

The drive sheave then transfers a force that essentially corresponds to the weight difference between either the hoist cage plus load and the counterweight or the counterweight and the empty hoist cage. Also the weight of the ropes affects said force if there are no "compensation" ropes. The weight of the ropes thus reduces the load capacity and becomes an increasing problem at increasing host system heights. As a remedy it is conventional at high hoist system heights to compensate for this "rope unbalance", i.e. the weight of ropes, by hanging "compensation" ropes with a corresponding weight below and between the hoist cage and the counterweight.

One object of the present invention is to eliminate the needs of a counterweight and of compensation for the "rope unbalance".

SUMMARY OF THE INVENTION

The invention provides a traction drive system for wire rope hoists, wherein the hoist cage, or the like, is carried by a single loop of ropes that passes through a traction sheave and the ends of which are each connected to a drum, said drums being connected with the hoist cage and being mutually couplied for rotation with different peripheral speeds under the action of the driven movement of said loop, the end portions of said loop extending in opposite directions over the respective drums.

By means of the invention the force acting in the ropes attached to one of the drums balances the force acting in the ropes attached to the other drum plus the weight of the hoist cage with or without load. How to dimension this "rope balancing system" will depend upon the actual weights and upon the forces to be transmitted via the drive sheave. The invention also eliminates the above-mentioned "rope unbalance" due to the fact that the drive ropes extend in a single loop over the drive sheave and an associated follower sheave, located vertically above each other.

BRIEF DESCRIPTION OF THE DRAWINGS

One embodiment of the invention shall now be described more closely below with reference to the attached drawing, on which FIG. 1 schematically and not to scale in a side view illustrates a drive system according to the invention, and FIG. 2 in more detail, but still not necessarily to scale, shows a view, partly in section, in the direction of arrows II—II in FIG. 1.

DESCRIPTION OF PREFERRED EMBODIMENTS

Figure 1:
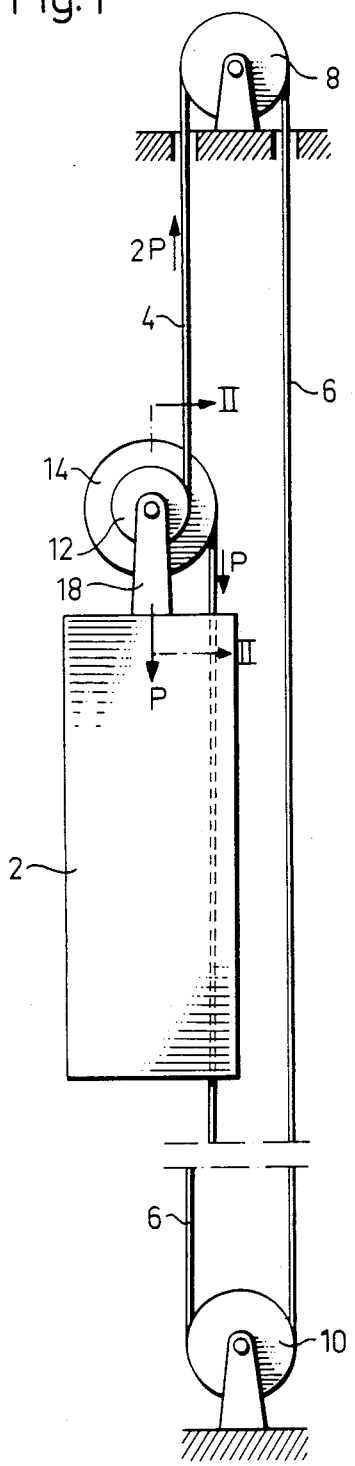
Figure 2:
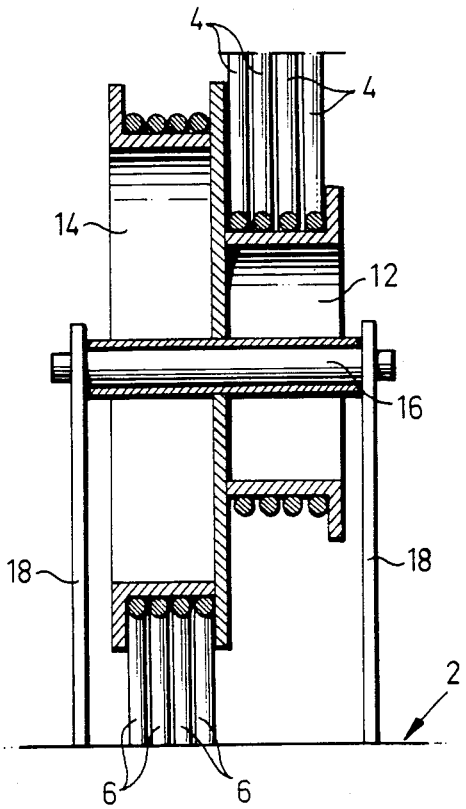

In the embodiment shown, a hoist cage 2 is carried by a single loop of wire ropes 4,6. The loop passes a traction sheave 8 at its upper end and a follower sheave 10 at its lower end. The ends of the loop are attached to one drum 12 and 14, respectively, each. As appears from FIG. 1 the ropes extending from the drum 12 change reference numeral from 4 to 6 when they pass the sheave 8. The drums 12, 14 are interconnected in the way appearing from FIG. 2, i.e. they are coaxially and rigidly connected to each other. The end portion of the part 4 of the loop extends clockwise over the drum 12, as seen in FIG. 1. The end portion of the part 6 of the loop extends anticlockwise over the drum 14. In other words the end portions of parts 4 and 6 extend in opposite directions relative to each other over the drums 12 and 14, respectively.

The interconnected drums 12, 14 are arranged on top of the hoist cage 2, rotatably arranged on a shaft 16 carried by two supports 18. As appears from FIG. 2 the loop 4, 6 comprises four ropes in the embodiment shown.

Also in the illustrated embodiment, the radius of the drum 12 is half that of the drum 14. This gives force equilibrium under the force conditions illustrated in FIG. 1. If the cage and its load impose a force P on the system, then the forces to be taken by the ropes 4, the ropes 6, and the drive sheave 8 will be 2P,P, and P, respectively.

During installation of the hoist the ropes are first mounted while the hoist cage is located on supports. After mounting of the ropes the supports are removed and the hoist cage glides downwardly. Simultaneously, the two drums are rotating, which implies that the ropes 4 are unwound from the smaller drum 12 and the ropes 6 are wound onto the greater drum 14. Since the drums 12 and 14 are rotating together, and since the portions of the ropes 4 which are unwound from the smaller drum 12 are not as great as the portions of the ropes 6 which are wound onto the greater drum 14 during the downward movement of the cage, eventually the entire loop of ropes 4 and 6 is thereby shortened and ultimately tensioned. The cage stops when the ropes are tensioned and the above-mentioned equilibrium has been reached.

The invention is not limited to the embodiment shown on the drawing. The drum diameters should be chosen with due respect taken to any directions relating to the groove angle of the drive sheave 8 and the surface pressure. This, as well as the number of ropes to be used, should be determined in connection with the final constructional work.

If e.g. the ratio between the drum diameters is chosen as 3/2, the force will be 3P in the ropes 4 and 2P in the ropes 6. The force to be taken up by the ropes will thus become higher, but a greater groove angle can be chosen that gives a lower surface pressure.

In the arrangement according to the invention rope length changes due to elongation or temperature variations are automatically taken up via the rope drums. Thus, the ropes are always maintained stretched.

Different modifications of the dimensioning and mutual coupling of the drums are conceivable. Instead of being completely united the drums can thus be interconnected via a toothed wheel gearing that gives the desired ratio between the peripheral speeds of the drums at determined diameters of the drums. In this case the drums can thus have the same diameter. It should be noted that if the rigid connection between the drums is dispensed with, they need not necessarily be arranged coaxially, but can be mutually positioned at an angle and remote from each other.

In an alternative arrangement (not shown), the drive sheave 8 and the follower sheave 10 may be interchanged in position. That portion of the rope loop 6 extending all the way from the top sheave to the bottom sheave then takes the force 2P.

I claim:

1. A traction drive system for wire rope hoists comprising a hoist cage arranged to traverse a substantially vertical path, a traction sheave positioned at one end of said path, an idler sheave positioned at the other end of said path, two drums mounted for rotation upon said hoist cage, a loop of rope for supporting the cage and having one end wrapped around and attached to a first one of said drums, said loop of rope extending from said first drum around said traction sheave and said idler sheave and having the other end wrapped around and attached to the other one of said drums, said drums being mutually coupled for rotation at different peripheral speeds for taking up and paying out the ropes thereto at different speeds, the mutual coupling and the direction of the wrapping of the wrapped portions of the ends of said rope loop upon said drums being arranged to provide for one end of the rope loop to be taken up on one drum while the other end of the rope loop is paid out from the other drum in response to mutually coupled drum rotation with the rope speed being greater from the drum from which the rope loop extends downwardly.

2. A system as claimed in claim 1 wherein said two drums are mounted for rotation upon a common axis.

3. A system as claimed in claim 2 wherein said mutual coupling of said drums for rotation at different peripheral speeds is carried out by providing drums of different diameters which are rigidly interconnected for rotation together.

4. A system as claimed in claim 1 or claim 2 wherein said drums have different diameters.

5. A system as claimed in any one of claims 1, 2, or 3, wherein said drums are mounted upon the top of said hoist cage.

6. A system as claimed in any one of claims 1, 2, or 3, wherein said loop of rope comprises a plurality of ropes arranged in parallel.

* * * * *